US008928688B2

(12) United States Patent
Hung

(10) Patent No.: US 8,928,688 B2
(45) Date of Patent: Jan. 6, 2015

(54) METHOD FOR DITHERING IN DISPLAY PANEL AND ASSOCIATED APPARATUS

(75) Inventor: Kuo-Hsiang Hung, Kaohsiung (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 193 days.

(21) Appl. No.: 13/453,004

(22) Filed: Apr. 23, 2012

(65) Prior Publication Data

US 2012/0268478 A1 Oct. 25, 2012

(30) Foreign Application Priority Data

Apr. 22, 2011 (TW) ..... 100114156 A

(51) Int. Cl.
*G09G 5/02* (2006.01)
*G09G 3/20* (2006.01)

(52) U.S. Cl.
CPC ..... *G09G 3/2051* (2013.01); *G09G 3/2003* (2013.01); *G09G 2310/0256* (2013.01); *G09G 2320/0247* (2013.01)
USPC ..... 345/596; 345/613

(58) Field of Classification Search
CPC ..... G09G 5/02; G09G 2320/0247; G09G 3/3614; G09G 3/3648; G09G 3/3607; G09G 2300/0809; G09G 3/2074; G09G 3/2022; G09G 3/2055; G09G 3/2044; G02F 1/133514; G02F 2203/30
USPC ..... 345/596, 613
See application file for complete search history.

(56) References Cited

U.S. PATENT DOCUMENTS

| | | | | |
|---|---|---|---|---|
| 6,469,684 | B1 * | 10/2002 | Cole | 345/58 |
| 2008/0180378 | A1 * | 7/2008 | Tang | 345/96 |
| 2010/0103206 | A1 * | 4/2010 | Kamada et al. | 345/690 |
| 2012/0154428 | A1 * | 6/2012 | Barnhoefer | 345/596 |
| 2012/0236021 | A1 * | 9/2012 | Parmar et al. | 345/597 |

FOREIGN PATENT DOCUMENTS

WO EP 2466575 A2 * 12/2010 ..... G09G 5/02

OTHER PUBLICATIONS

Seung-Woo Lee, Common Voltage Control Technology for Highly Reliable Active Matrix Liquid Crystal Displays, Feb. 2008, Optical Engineering 47(2), 024001, p. 1-5.*
Nam et al., Dithering Artifacts in Liquid Crystal Displays and Analytic Solution to Avoid Them, 2009, IEEE, 0098 3063/09, p. 1-5.*

* cited by examiner

*Primary Examiner* — Kee M Tung
*Assistant Examiner* — Yuehan Wang
(74) *Attorney, Agent, or Firm* — Edell, Shapiro & Finnan, LLC

(57) ABSTRACT

A dithering method and associated apparatus is provided. The method synthesizes a dither pattern including a plurality of elements. At least two of the plurality of elements are of a same value, and at least two of the elements of the same value respectively associate with different driving polarities to prevent flickering. While sub-pixel data of a sub-pixel corresponds between two predetermined color levels of the sub-pixel, a color level displayed by the sub-pixel is determined from the two predetermined color levels according to a sum of the sub-pixel data and the element corresponding to the sub-pixel.

19 Claims, 11 Drawing Sheets

A

| | | | |
|---|---|---|---|
| 1 | 3 | 2 | 0 |
| 2 | 0 | 1 | 3 |
| 0 | 2 | 3 | 1 |
| 3 | 1 | 0 | 2 |

B

| | | | |
|---|---|---|---|
| 3 | 1 | 0 | 2 |
| 0 | 2 | 3 | 1 |
| 2 | 0 | 1 | 3 |
| 1 | 3 | 2 | 0 |

C

| | | | |
|---|---|---|---|
| 2 | 0 | 1 | 3 |
| 1 | 3 | 2 | 0 |
| 3 | 1 | 0 | 2 |
| 0 | 2 | 3 | 1 |

D

| | | | |
|---|---|---|---|
| 0 | 2 | 3 | 1 |
| 3 | 1 | 0 | 2 |
| 1 | 3 | 2 | 0 |
| 2 | 0 | 1 | 3 |

W

| | | | |
|---|---|---|---|
| 3 | 1 | 0 | 2 |
| 1 | 3 | 2 | 0 |
| 0 | 2 | 3 | 1 |
| 2 | 0 | 1 | 3 |

X

| | | | |
|---|---|---|---|
| 2 | 0 | 1 | 3 |
| 0 | 2 | 3 | 1 |
| 1 | 3 | 2 | 0 |
| 3 | 1 | 0 | 2 |

Y

| | | | |
|---|---|---|---|
| 1 | 2 | 3 | 0 |
| 2 | 1 | 0 | 3 |
| 3 | 0 | 1 | 2 |
| 0 | 3 | 2 | 1 |

Z

| | | | |
|---|---|---|---|
| 0 | 3 | 2 | 1 |
| 3 | 0 | 1 | 2 |
| 2 | 1 | 0 | 3 |
| 1 | 2 | 3 | 0 |

FIG. 5

DTM1 @F(k)

| | | | |
|---|---|---|---|
| 7 | 13 | 8 | 2 |
| 9 | 3 | 6 | 12 |
| 0 | 10 | 15 | 5 |
| 14 | 4 | 1 | 11 |

DTM1 @F(k+1)

| | | | |
|---|---|---|---|
| 14 | 4 | 1 | 11 |
| 0 | 10 | 15 | 5 |
| 9 | 3 | 6 | 12 |
| 7 | 13 | 8 | 2 |

DTM1 @F(k+2)

| | | | |
|---|---|---|---|
| 9 | 2 | 7 | 12 |
| 6 | 13 | 8 | 3 |
| 15 | 4 | 1 | 10 |
| 0 | 11 | 14 | 5 |

DTM1 @F(k+3)

| | | | |
|---|---|---|---|
| 0 | 11 | 14 | 5 |
| 15 | 4 | 1 | 10 |
| 6 | 13 | 8 | 3 |
| 9 | 2 | 7 | 12 |

T0(1)

DTM1 @F(k+4)

| | | | |
|---|---|---|---|
| 6 | 12 | 9 | 3 |
| 8 | 2 | 7 | 13 |
| 1 | 11 | 14 | 4 |
| 15 | 5 | 0 | 10 |

DTM1 @F(k+5)

| | | | |
|---|---|---|---|
| 13 | 6 | 3 | 8 |
| 2 | 9 | 12 | 7 |
| 11 | 0 | 5 | 14 |
| 4 | 15 | 10 | 1 |

DTM1 @F(k+6)

| | | | |
|---|---|---|---|
| 8 | 3 | 6 | 13 |
| 7 | 12 | 9 | 2 |
| 14 | 5 | 0 | 11 |
| 1 | 10 | 15 | 4 |

DTM1 @F(k+7)

| | | | |
|---|---|---|---|
| 3 | 9 | 12 | 6 |
| 13 | 7 | 2 | 8 |
| 4 | 14 | 11 | 1 |
| 10 | 0 | 5 | 15 |

T0(2)

FIG. 6

DTM1 @F(k+8)

| | | | |
|---|---|---|---|
| 5 | 14 | 11 | 0 |
| 10 | 1 | 4 | 15 |
| 3 | 8 | 13 | 6 |
| 12 | 7 | 2 | 9 |

DTM1 @F(k+9)

| | | | |
|---|---|---|---|
| 12 | 7 | 2 | 9 |
| 3 | 8 | 13 | 6 |
| 10 | 1 | 4 | 15 |
| 5 | 14 | 11 | 0 |

DTM1 @F(k+10)

| | | | |
|---|---|---|---|
| 11 | 1 | 4 | 14 |
| 5 | 15 | 10 | 0 |
| 12 | 6 | 3 | 9 |
| 2 | 8 | 13 | 7 |

DTM1 @F(k+11)

| | | | |
|---|---|---|---|
| 2 | 8 | 13 | 7 |
| 12 | 6 | 3 | 9 |
| 5 | 15 | 10 | 0 |
| 11 | 1 | 4 | 14 |

T0(3)

DTM1 @F(k+12)

| | | | |
|---|---|---|---|
| 4 | 15 | 10 | 1 |
| 11 | 0 | 5 | 14 |
| 2 | 9 | 12 | 7 |
| 13 | 6 | 3 | 8 |

DTM1 @F(k+13)

| | | | |
|---|---|---|---|
| 15 | 5 | 0 | 10 |
| 1 | 11 | 14 | 4 |
| 8 | 2 | 7 | 13 |
| 6 | 12 | 9 | 3 |

DTM1 @F(k+14)

| | | | |
|---|---|---|---|
| 10 | 0 | 5 | 15 |
| 4 | 14 | 11 | 1 |
| 13 | 7 | 2 | 8 |
| 3 | 9 | 12 | 6 |

DTM1 @F(k+15)

| | | | |
|---|---|---|---|
| 1 | 10 | 15 | 4 |
| 14 | 5 | 0 | 11 |
| 7 | 12 | 9 | 2 |
| 8 | 3 | 6 | 13 |

T0(4)

FIG. 7

METHOD FOR DITHERING IN DISPLAY PANEL AND ASSOCIATED APPARATUS

This application claims the benefit of Taiwan application Serial No. 100114156, filed Apr. 22, 2011, the subject matter of which is incorporated herein by reference.

BACKGROUND OF THE INVENTION

1. Field of the Invention

The invention relates in general to a method for dithering in a display panel and associated apparatus, and more particularly to a method for dithering and associated apparatus that prevents flickering.

2. Description of the Related Art

A display panel is one of the most crucial human-machine interfaces (HMI) in modern electronic systems. As such, there is on-going research and development to provide low-cost and high-performance display panels.

SUMMARY OF THE INVENTION

A display panel displays frames of video data with a plurality of pixels. Each pixel comprises a plurality of sub-pixels respectively displaying color levels of different colors. A bit count of a color level represents a color display capability of a display panel. For example, in a display panel of 6-bit color, each sub-pixel is capable of presenting 64 color levels.

In order to display color images in a modern electronic system, sub-pixel data corresponding to sub-pixels in a frame may reach 8 bits, and may further reach 10 bits by adding a 2 bit requirement for color temperature, meaning that the sub-pixel data for each pixel may need to be able to present 1024 color levels. However, each pixel of a 6-bit display panel is only capable of presenting 64 color levels. As a result, dithering arises in response to the need of displaying high-bit (e.g., 8-bit or 10-bit) sub-pixel data on a low-bit (e.g., 6-bit) display panel.

Suppose color levels L0 and L1 are two neighboring colors levels displayable by each sub-pixel. Through displaying the color level L1 by n sub-pixels among 4*4 sub-pixels, where n is greater than 0 and smaller than 16, and simultaneously displaying the color level L0 by the remaining (16−n) sub-pixels, the color level (L0+n*(L1−L0)/16) can be simulated by the 4*4 sub-pixels. Further, supposing a sub-pixel is to display a color level L1 in n frames among 16 continuous frames and a color level L0 in the remaining (16−n) frames, the sub-pixel temporally simulates color levels (L0+n*(L1−L0)/16) that cannot be originally displayed.

By simulating the color level (L0+n*(L1−L0)/16) between the neighboring color levels L0 and L1 displayable by a 6-bit display panel, the display panel, in equivalence, can display the full 10-bit color level required by the 10-bit sub-pixel data. Therefore, by multiplying the 6-bit color levels L0 and L1 by 16 (i.e., 2 to the power of 4), the two 6-bit color levels respectively represent 10-bit color levels 16*L0 and 16*L1=16L0+16.

Preferably, a driving polarity of the sub-pixels is taken into consideration when synthesizing a dither pattern to prevent any undesirable effects of dithering effects.

A dithering method applied to a display panel for displaying an image data is disclosed. The image data comprises a plurality of frames respectively comprising a plurality of sub-pixel data each corresponding to a sub-pixel. The display panel comprises a plurality of pixels each comprising a plurality of sub-pixels. Each sub-pixel associates with one of driving polarities, and is capable of displaying a plurality of color levels to present the corresponding sub-pixel data. The dither pattern comprises a plurality of elements each corresponding to a sub-pixel. At least two elements of the plurality of elements are of a same value, and at least two of the elements of the same value respectively correspond to sub-pixels of different driving polarities for alleviating flickering caused by a same driving polarity.

The dither pattern comprises a plurality of dither matrices each comprising a plurality rows and a plurality columns of elements. For example, the dither pattern is an 8*8 matrix consisting of 4 dither matrices. Each dither matrix is a 4*4 matrix corresponding to 4*4 sub-pixels on the display panel. The elements in each dither matrix may be a 4-bit number, and the 4*4 elements in a same dither matrix are different, with the values of the elements ranging from 0 to 15. That is, each dither matrix comprises a value equal to d (where d is greater than or equal to 0 and smaller than or equal to 15), such that the four dither patterns of the entire dither pattern comprises four elements with a value equal to d. To reduce flickering, the elements with the same value d in different dither matrices respectively correspond to sub-pixels of different polarities; two elements with the value d correspond to a positive polarity and the other two elements with the value d correspond to a negative polarity.

When performing dithering according to the above dither pattern/dither matrices, the 10-bit sub-pixel data of each sub-pixel and corresponding elements in the dither pattern are added to first obtain a sum. The last four bits are removed from the sum to obtain a 6-bit result, which is then a 6-bit color level to be displayed by each sub-pixel. While simulating the 10-bit color level (16*L0+n) of the 10-bit sub-pixel data by utilizing the 4*4 sub-pixels corresponding to the 4*4 dither matrix, supposing the value of the corresponding element in the dither matrix of a predetermined sub-pixel is d, a value (d+n) greater than or equal to 16 means that a sum of the sub-pixel data and the element d is greater than or equal to (16*L0+16), so that a result by removing the last four bits is equivalent to the 6-bit color level (L0+1). In contrast, a value (d+n) smaller than 16 means that the sub-pixel is supposed to display the 6-bit color level L0. Since the 16 elements in the same dither matrix are respectively 0 to 15, the 6-bit color level (L0+1) is displayed by n sub-pixels of the corresponding 4*4 sub-pixels while the 6-bit color level L0 is displayed by the remaining (16−n) sub-pixels.

When sequentially displaying different frames of the image data, the dither pattern is resynthesized. The elements of the same value in the dither pattern respectively correspond to sub-pixels of different polarities. When resynthesizing the dither pattern, an element corresponding to a same sub-pixel is periodically a different value in every 16 frames.

When defining the dither matrices in the dither pattern, one of the dither matrices is defined according to a dot matrix and a block matrix. Row-switching and column-switching is performed on the dot matrix and the block matrix to provide switched dot matrices and switched block matrices, and the other dither matrices are defined according to the switched dot matrices and the switched block matrices. The dot matrix and the block matrix may be 4*4 matrices each comprising 4*4 elements.

The elements in the dot matrix and the block matrix may be 2-bit numbers with a value greater than or equal to 0 and smaller than or equal to 3. In each column and each row of the dot matrix and the block matrix, the four elements of a same column/row have different numbers ranging from 0 to 3.

Preferably, the dot matrix is multiplied by a predetermined value of 4 and then added to the block matrix to obtain a dither matrix; the remaining three switched dot matrices are also multiplied by 4 and then respectively added to the three switched block matrices to obtain the other three dither matrices. More specifically, for the 4-bit elements in the dither matrix, the two most significant bits are the 2-bit elements of the dot matrix, and the two least significant bits are the 2-bit elements of the block matrix. Further, the four elements with a same value of d (d being greater than or equal to 0 and smaller than or equal to 3) in the dot matrix and the switched dot matrices respectively correspond to four elements with different values in the dot matrix and the switched dot matrices; that is, the value is one from 0 to 3. Therefore, by forming the dither matrix from combining the dot matrix/switched dot matrices and the block matrix/switched block matrices, the elements in the dither matrix fully cover all the numbers from 0 to 15.

In the dither matrix from combining the dot matrix/switched dot matrices and the block matrix/switched block matrices, since elements of the same value do not appear in a same column or a same row, n sub-pixels displaying the color level L1 are evenly distributed among the columns and rows when simulating the color level (L0+n*(L1−L0)/16) by displaying one of the color levels L0 and L1 with the 4*4 corresponding sub-pixels in the dither matrices. Supposing n=(4*n1+n0) (where n0 is greater than 0 and smaller than 4, and n1 is greater than or equal to 0 and smaller than 4), in the four corresponding columns of a same dither matrix, the color level L1 is displayed by (n1+1) sub-pixels in the n0 column and is respectively displayed by n1 sub-pixels in the other columns. Similarly, in four rows corresponding to a same dither matrix, the color level L1 is displayed by (n1+1) sub-pixels in the n0 row and is respectively displayed by n1 sub-pixels in the other rows. With the arrangement above, a maximum difference between the numbers of sub-pixels in respective columns/rows for displaying the color level L1 does not exceed one such that the sub-pixels for displaying the color level L1 are not concentrated at a same column/row. For example, when n=9, the color level L1 is displayed by three sub-pixels in a predetermined column/row is displayed by two sub-pixels in the other three columns/rows.

Preferably, the dot matrix/switched dot matrices and the block matrix/switched block matrices are redefined as the frames are updated to redefine the dither matrices and the dither pattern. The dot matrix and the block matrix may be redefined according to a predetermined dot matrix sequence and a predetermined block matrix sequence, respectively. For example, the dot matrix sequence corresponds to four different dot matrices A, B, C and D. When redefining the dot matrix, one from the four dot matrices corresponding to the dot matrix sequence is periodically selected, with four frames being regarded as one period. When redefining the block matrix, one from the sixteen block matrices corresponding to the block matrix sequence is periodically selected, with sixteen frames being regarded as one period. The block matrix sequence may be formed by four different block matrices W, X, Y and Z. For example, the block matrix sequence is W, X, Y, Z, X, Y, Z, W, Y, Z, W, X, Z, W, X and Y.

In other words, in the sixteen neighboring frames from frame k to frame (k+15), the dot matrices are respectively A, B, C, D, A, B, C, D, A, B, C, D, A, B, C and D; the block matrices are respectively W, X, Y, Z, X, Y, Z, W, Y, Z, W, X, Z, W, X and Y. In the 16-frame period, each dot matrix appears a plurality of times in a plurality of frames, and corresponds to a different block matrix in each appearance. For example, the dot matrix A appears in frames k, (k+4), (k+8) and (k+12). In these frames, the corresponding block matrices are respectively W, X, Y and Z. With such sequence, each element of the dither matrix is respectively set to one from 0 to 15 in the 16-frame period to perform temporal dithering.

To switch a same predetermined sub-pixel among sixteen frames to display the neighboring color levels L0 and L1 in order to simulate the color level (L0+n*(L1−L0)/16), since the dot matrix/switched dot matrices control the two most significant bits of the elements in the dither matrices, n frames for displaying the color level L1 are evenly distributed to four 4-frame periods that are also periods in which the dot matrix/switched dot matrices are redefined. That is, when n=(4*n1+n0) (where n0 is greater than 0 and smaller than 4, and n1 is greater than or equal to 0 and smaller than 4), the color level L1 is to be displayed (n1+1) times within n0 4-frame periods, and to be displayed n1 times in the other 4-frame periods. In each 4-frame period, the number of times (frames) for displaying the color level L1 varies by once the maximum, and is not excessively concentrated in a same 4-frame period. For example, when n=9, a predetermined sub-pixel respectively displays the color level L1 three times in three frames of one 4-frame period, and respectively displays the color level L1 twice in the other three 4-frame periods.

The present invention further provides a dither control circuit comprising a dot matrix generator, a block matrix generator, a switching module, a dither pattern generator and a dithering module. The dot matrix generator and the block matrix generator respectively generate a dot matrix and a block matrix. The switching module performs column-switching and row-switching on the dot matrix and the block matrix to provide a switched dot matrix and a switched block matrix. The dither pattern generator synthesizes dither matrices and a dither pattern according to the dot matrix/switched dot matrix and the block matrix/switched dot matrix. The dithering module determines color levels to be displayed by the sub-pixels according to the dither pattern.

The above and other aspects of the invention will become better understood with regard to the following detailed description of the preferred but non-limiting embodiments. The following description is made with reference to the accompanying drawings.

BRIEF DESCRIPTION OF THE DRAWINGS

FIG. 5 is a diagram of the dot matrices and block matrices in FIG. 4 according to an embodiment of the present invention.

FIGS. 6 and 7 are diagrams of updating the dither matrices in FIG. 4 as frames switch according to an embodiment of the present invention.

DETAILED DESCRIPTION OF THE INVENTION

Figure 1:
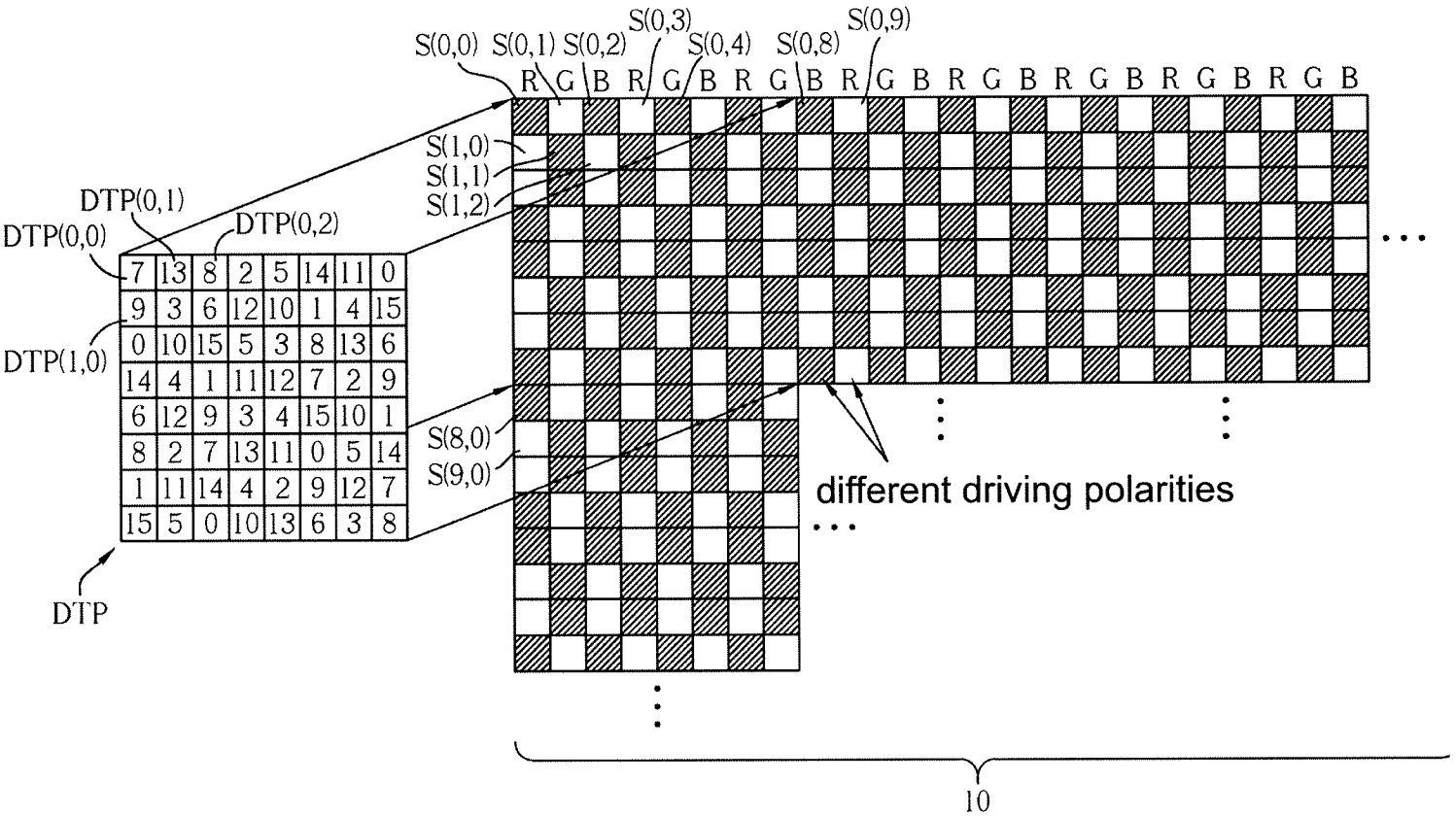
FIG. 1 a dither pattern applied to a display panel according to an embodiment of the present invention.

FIG. 1 shows a dither pattern DTP applied to a display panel 10 according to an embodiment of the present invention. The display panel 10 comprises a plurality of sub-pixels S(i, j). For example, sub-pixels S(0, 0), S(0, 1) and S(0, 2) are respectively a red sub-pixel R, a green sub-pixel G and a blue sub-pixel B of a same pixel. Sub-pixels S(0, 3) and S(0, 4) on a same scan line are respectively a red sub-pixel R and a green sub-pixel G of a next pixel, and so forth. An R sub-pixel S(1, 0), a G sub-pixel S(1, 1) and a B sub-pixel S(1, 2) form a pixel of a next scan line. To reduce power consumption as well as preventing residual image, the sub-pixels are driven according to alternate and different polarities. In FIG. 1, shaded sub-pixels and unshaded sub-pixels represent two types of sub-pixels with different polarities. For example, the sub-pixels S(0, 0), S(1, 1) and S(0, 2) are of a same driving polarity, and the sub-pixels S(0, 1), S(1, 0) and S(1, 2) are of an opposite driving polarity.

In FIG. 1, the dither pattern DTP is an 8*8 (i.e., 8 rows and 8 columns) matrix comprising a plurality of elements DTP(i, j) each corresponding to a sub-pixel. For example, elements DTP(0, 0), DTP(0, 1) and DTP(0, 2) respectively correspond to the sub-pixels S(0, 0), S(0, 1) and S(0, 2), an element DTP(1, 0) corresponds to the sub-pixel (1, 0), and so forth. To cover all sub-pixels on the display panel 10, the dither pattern DTP is applied in iteration, such that a sub-pixel S(i, j) corresponds to an element DTP(mod(i, 8), mod(j, 8)), where mod is a congruence function and mod(i, 8) is a remainder of dividing i by 8. For example, sub-pixels (0, 8) and (0, 9) respective correspond to the elements DTP(0, 0) and DTP(0, 1), and sub-pixels S(8, 0) and S(9, 0) respectively correspond to the elements DTP(0, 0) and DTP(1, 0).

Figure 2:
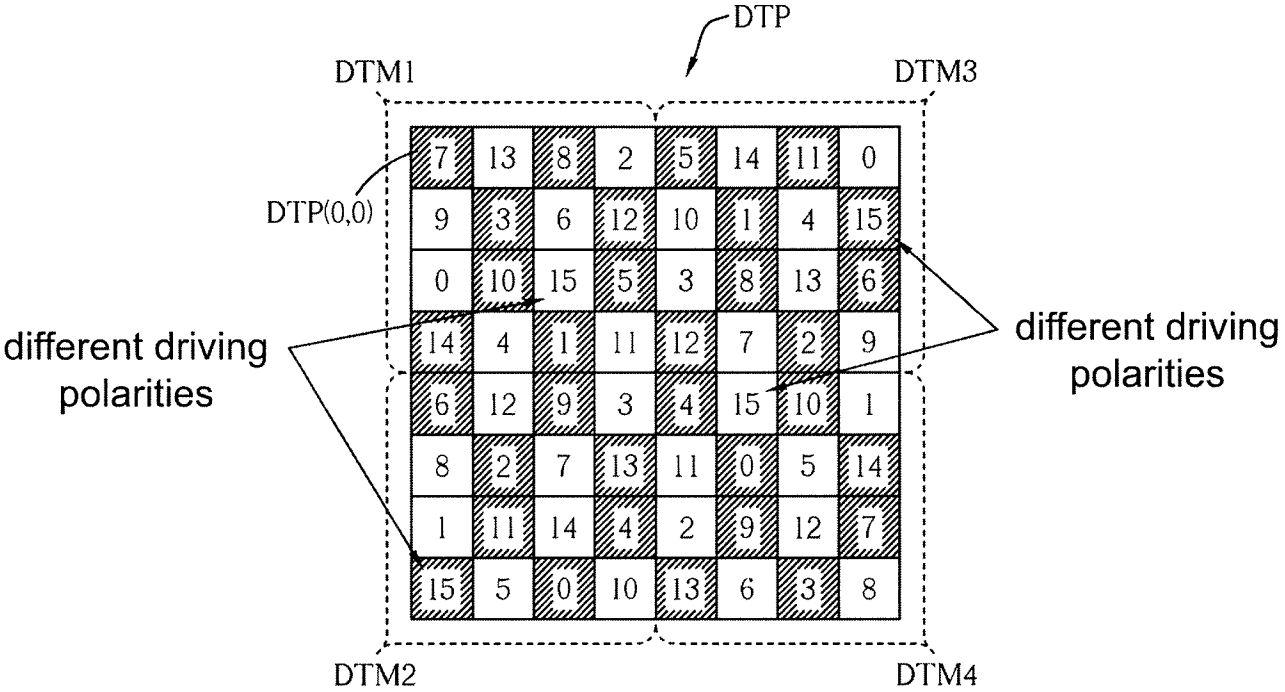
FIG. 2 is a diagram of forming the dither pattern from dither matrices according to an embodiment of the present invention.

FIG. 2 illustrates characteristics of the dither pattern DTP in FIG. 1. In FIG. 2, sub-pixels corresponding to elements DTM(i, j) are also marked by shading or unmarked. For example, an element DTM(0, 0) corresponds to a sub-pixel S(0, 0), and so the driving polarity corresponding to the element DTM(0, 0) is shaded.

In FIG. 2, the dither pattern DTP comprises four dither matrices DTM1 to DTM4 each being a 4*4 matrix comprising 4*4 elements respectively corresponding to 4*4 sub-pixels on the display panel 10. Elements DTM1(i, j), DTM2(i, j), DTM3(i, j) and DTM4(i, j) are respectively elements DTP(i, j), DTP(i+4, j), DTP(i, j+4) and DTP(i+4, j+4), where i and j are both greater than or equal to 0 and smaller than or equal to 3. The elements in each dither matrix may be a 4-bit number, and the 4*4 elements in a same dither matrix are different from one another, such that a value of respective element is one from 0 to 15. For example, in the dither matrix DTM1, the values of elements DTM1(2, 0), DTM1(3, 2), DTM1(0, 3), DTM1(1, 1), DTM1(3, 1), DTM1(2, 3), DTM1(1, 2), DTM1(0, 0), DTM1(0, 2), DTM1(1, 0), DTM1(2, 1), DTM1(3, 3), DTM1(1, 3), DTM1(0, 1), DTM1(3, 0) and DTM1(2, 2) are respectively 0 to 15. Therefore, each dither matrix comprises an element of a value equal to d, where d is greater than or equal to 0 and smaller than or equal to 15, so that the four dither matrices of the entire dither pattern comprise four elements of a value equal to d. For example, the values of the elements DTM1(2,2), DTM2(3,0), DTM3(1,3) and DTM4(0, 1) are equal to 15.

To alleviate flickering, when providing the dither matrices, elements of a same value d in different dither matrices are arranged to correspond to sub-pixels of different driving polarities. In this embodiment, two elements of the value d correspond to a same driving polarity while the other two elements of the value d correspond to a different driving polarity. For example, while the elements DTM1(2,2), DTM2(3,0), DTM3(1,3) and DTM4(0,1) all with a value of 15, the elements DTM1(2, 2) and DTM3(1, 3) correspond to a same polarity, and the elements DTM2(3, 0) and DTM4(0, 1) correspond to another polarity. Similarly, out of the elements DTM1(3, 0), DTM2(2, 2), DTM3(0, 1) and DTM4(1, 3) all with a value of 14, the elements DTM1(3, 0) and DTM4(1, 3) correspond to a same polarity, and the elements DTM2(2, 2) and DTM3(0, 1) correspond to another polarity. With the arrangement above, a color level difference of different polarities is balanced in a same frame to further balance visual differences, thereby alleviating flickering.

Figure 3:
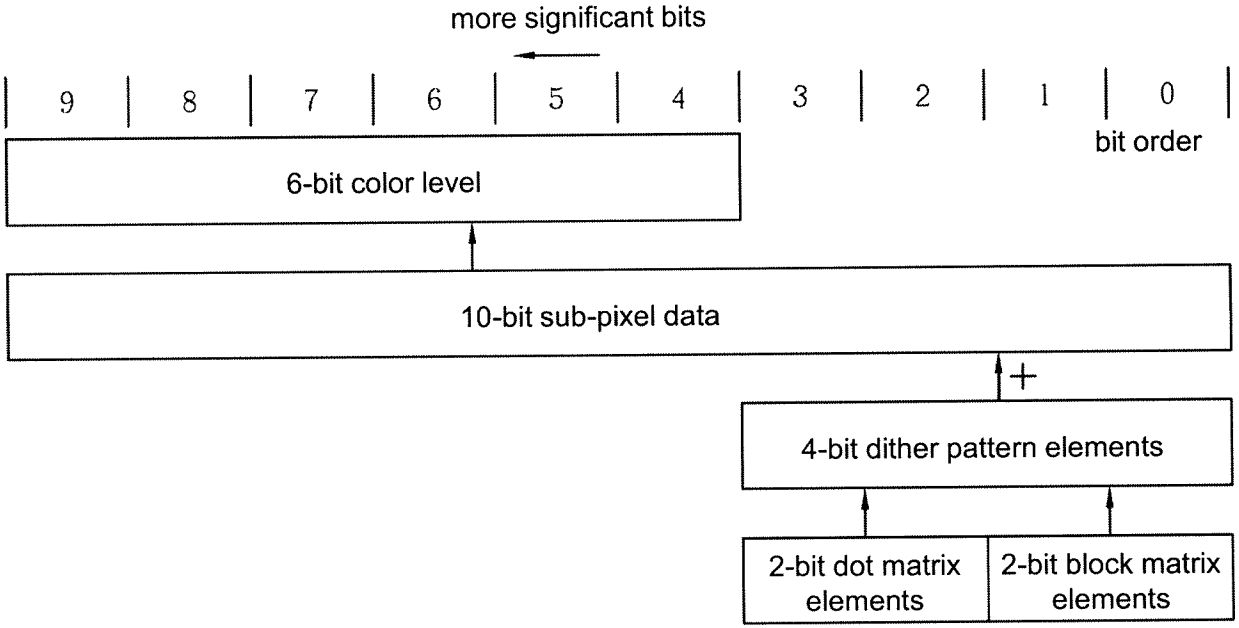
FIG. 3 is a diagram of dithering by implementing the dither pattern in FIG. 1 according to an embodiment of the present invention.

FIG. 3 shows dithering by applying the dither pattern DTP according to an embodiment of the present invention. While dithering, the 10-bit sub-pixel data of the sub-pixels are added to the corresponding 4-bit elements in the dither pattern to first obtain a sum, and the last 4 bits are removed from the sum to obtain a 6-bit result, which is the 6-bit color level to be displayed by each sub-pixel. Thus, simulating the 10-bit color level, (16*L0+n), of the 10-bit sub-pixel data is achieved by utilizing the 4*4 sub-pixels corresponding to the 4*4 dither matrix. Supposing the value of the corresponding element in the dither matrix of a predetermined sub-pixel is d, a value (d+n) greater than or equal to 16 means that a sum of the sub-pixel data and the element d is greater than or equal to (16*L0+16), so that a result by removing the last four bits represents the 6-bit color level (L0+1). In contrast, a value (d+n) smaller than 16 means that the sub-pixel is supposed to display the 6-bit color level L0. Since the 16 elements in the same dither matrix are respectively 0 to 15, the 6-bit color level (L0+1) is displayed by n sub-pixels in the corresponding 4*4 sub-pixels while the 6-bit color level L0 is displayed by the remaining (16−n) sub-pixels.

Figure 4:
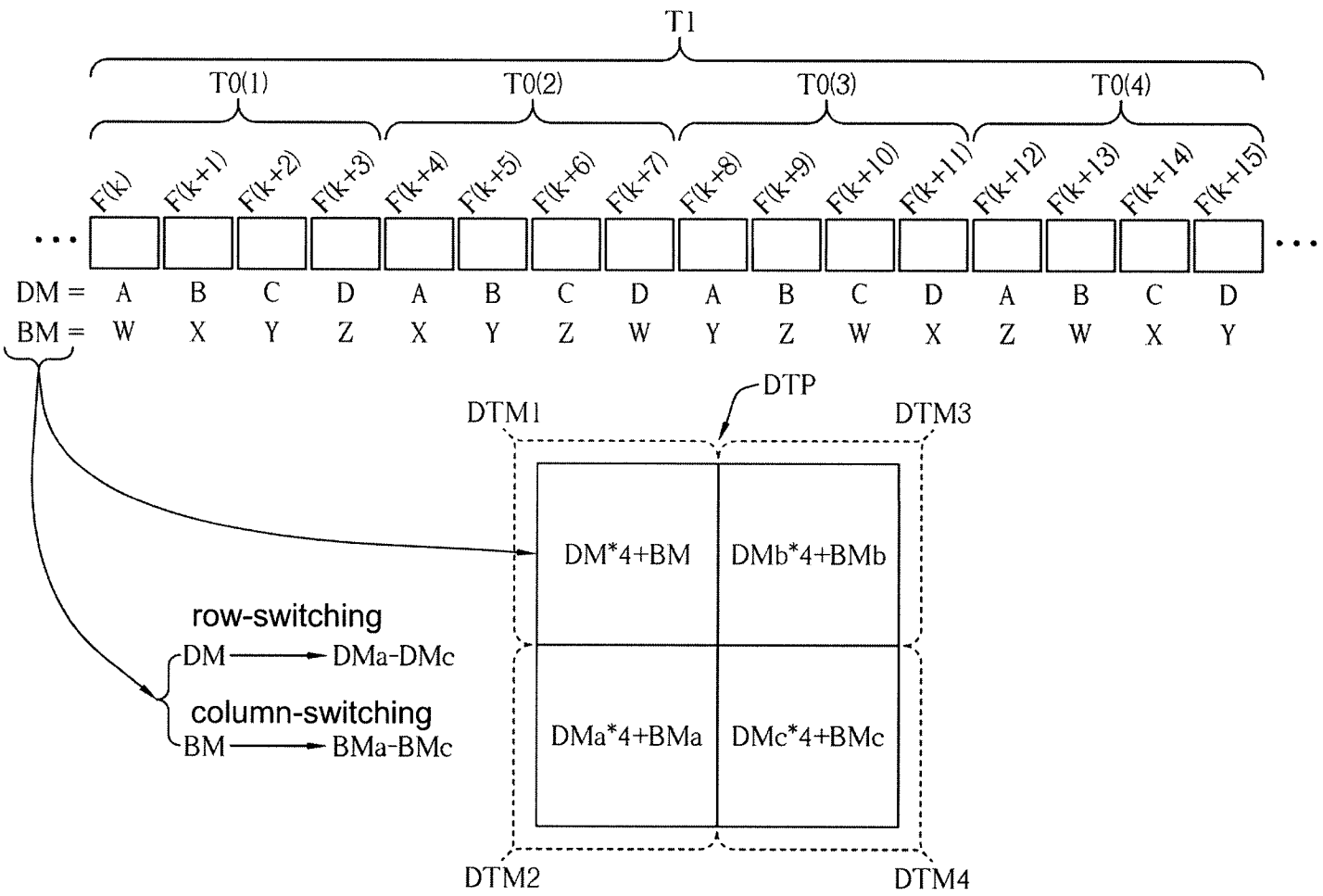
FIG. 4 is a diagram of updating the dither pattern in FIG. 1 as frames switch according to an embodiment of the present invention.

In one embodiment, the dither matrices are defined according to a dot matrix DM and a block matrix BM, as shown in FIG. 4. The dot matrix DM and the block matrix BM are respectively a 4*4 matrix each comprising 4*4 elements. The dither matrix DTM1 is obtained from (DM*4+BM). Further, row-switching is performed on the dot matrix DM to respectively obtain switched dot matrices DMa to DMc; column-switching is performed on the block matrix BM to respectively obtain switched block matrices BMa to BMc. As a result, the dither matrices DTM2 to DTM4 are respectively equal to (4*DMa+BMa), (4*DMb+BMb) and (4*DMc+BMc). To perform column-switching on a matrix means reordering the columns of the matrix. For example, column switching includes any of the following: switching column one with column two and column three with column four, switching column one with column three and column two with column four, and switching column one with column four and column two with column three. Similarly, to perform row-switching on a matrix means reordering the rows of the matrix.

In this embodiment, elements of the dot matrix DM and the block matrix BM may be 2-bit numbers with a value of greater than or equal to 0 and smaller than or equal to 3. Therefore, when calculating the 4-bit dither pattern elements in the dither matrix DTM1 according to (4*DM+BM), the 2-bit element in the dot matrix DM is applied as the two most significant bits of the dither pattern element, and the 2-bit element in the block matrix BM as the two least significant bits in the dither pattern element, as shown in FIG. 3. Similarly, for the 4-bit elements in the dither matrices DTM2/DTM3/DTM4, the two most significant bits are also formed by the corresponding 2-bit elements in the switched dot matrices DMa/DMb/DMc, and the two least significant bits are formed by the corresponding 2-bit elements in the switched block matrices BMa/BMb/BMc.

In this embodiment, with the design of forming the dither matrix from the dot matrix and the block matrix, compatibility is achieved for dithering between 8-bit sub-pixel data and 6-bit color levels. In the dithering conversion between 8 bits and 6 bits, due to the 2-bit difference between the sub-pixel data and the displayable color level, the required dither pattern may be constructed by the 2-bit dot matrix without implementing the block matrix. In 10-bit to 6-bit dithering conversion from 10-bit sub-pixel data to a 6-bit color level, the 4-bit difference is then simulated by a 4-bit dither pattern formed by a 2-bit dot matrix and a 2-bit block matrix. In other words, dithering from 8 bits to 6 bits and dithering from 10 bits to 6 bits may be independently designed, so that the dithering requirement of the latter may be reflected to the design of the block matrix without interfering the design of the dot matrix.

In this embodiment, the dot matrix/switched dot matrices and the block matrix/switched block matrices may be redefined as the frames are updated to redefine the dither matrices and the dither pattern, e.g., the dot matrix and the block matrix may respectively be redefined according to a predetermined dot matrix sequence and a block matrix sequence. For example, the dot matrix sequence corresponds to four different dot matrices A, B, C and D. When redefining the dot matrices, one of the four dot matrices corresponding to the dot matrix sequence is periodically selected one after another, with four frames being regarded as a period. As shown in FIG. 4, as a kth frame F(k) is in order updated to a (k+3)th frame F(k+3), the dot matrix is sequentially redefined as the dot matrices A, B, C and D. In the following four frames F(k+4) to F(k+7), the dot matrix DM is again sequentially redefined to the dot matrices A, B, C and D. Therefore, the frames F(k) to F(k+3) may be regarded as a four-frame period T0(1) of the dot matrix sequence, the frames F(k+4) to F(k+7) then correspond to a next four-frame period T0(2), and so forth.

Further, the block matrix sequence corresponds to 16 block matrices. When redefining the block matrices, one of the sixteen block matrices corresponding to the block matrix sequence is periodically selected one after another, with sixteen frames being regarded as a period T1. The block matrix is formed by four types of different block matrices W, X, Y and Z. In the embodiment in FIG. 4, the block matrix sequence corresponds the block matrices W, X, Y, Z, X, Y, Z, W, Y, Z, W, X, Z, W, X and Y. In other words, as the frame F(k) is sequentially updated to the frame F(k+15), the block matrix BM is respectively redefined to block matrices W, X, Y, Z, X, Y, Z, W, Y, Z, W, X, Z, W, X and Y. When the dot matrices DM/block matrices BM are redefined as the frames change, the switched dot matrices DMa/DMb/DMc and the switched block matrices BMa/BMb/BMc are also changed. Therefore, the dither matrices DTM1 to DTM4 to the dither pattern DTP are all updated along with switching of the frames.

When the dither pattern is updated along with the switching of the frames, the updated dither pattern maintains the abovementioned dither pattern characteristics. For example, the elements of a same value in the dither pattern respectively correspond to sub-pixels of different polarities, so as to utilize different driving polarities to alleviate flickering resulted from a same driving polarity. In addition, when redefining the dither pattern/dither matrices, an element corresponding to a same sub-pixel is periodically reset to a different value in every sixteen frames. In other words, sixteen frames are taken as a period, during which an element corresponding to a same sub-pixel changes between 0 to 15 as the frames switch, such that the values of the frames are respectively a value from 0 to 15. Accordingly, dithering is temporally realized.

FIG. 5 illustrates dot matrices A, B, C and D and block matrices W, X, Y and Z according to an embodiment of the present invention. As previously described, the elements in the dot matrices A, B, C and D serving as the dot matrix DM and the block matrices W, X, Y and Z serving as the block matrix BM are all 2-bit numbers, with a value of greater than or equal to 0 and smaller than or equal to 3. In each column and each row of the dot matrices and block matrices, the four elements of a same column are of different values respectively being one from 0 to 3, the four elements of a same row are also of different values respectively being one from 0 to 3. More specifically, elements of a same value do not exist in a same row or a same column. For example, in the dot matrix A, the four elements of row 0 are respectively different values of 1, 3, 2 and 0, and the four elements of row 2 are respectively different values of 2, 1, 3, and 0. In the dot matrix A, the values of elements A(0, 1), A(1, 3), A(2, 2) and A(3, 0) are all 3; however, any two elements of a same value are not arranged in a same column or a same row. Similarly, in the block matrix Z, the four elements of row 1 are respectively different values of 3, 0, 1 and 2, and the four elements of row 0 are respectively different values of 0, 3, 2, and 1. In the block matrix Z, the values of elements Z(0, 2), Z(1, 3), Z(2, 0) and Z(3, 1) are all 2; however, any two elements of a same value are not arranged in a same column or a same row.

The four elements of a same value in the dot matrix DM correspond to four elements of different values in the block matrix. Therefore, when forming the dither matrix DTM1 by combining the dot matrix DM and the block matrix BM, the sixteen 4-bit elements in the dither matrix DTM1 cover all values from 0 to 15. For example, in the dot matrix B, the values of elements B(0, 0), B(1, 2), B(2, 3) and B(3, 1) are all 3; the values of corresponding elements W(0, 0), W(1, 2), W(2, 3) and W(3, 1) in the block matrix W are respectively different values of 3, 2, 1 and 0, the values of corresponding elements X(0, 0), X(1, 2), X(2, 3) and X(3, 1) in the block matrix X are respectively different values of 2, 3, 0 and 1, the values of corresponding elements Y(0, 0), Y(1, 2), Y(2, 3) and Y(3, 1) in the block matrix Y are respectively different values of 1, 0, 2 and 3, and the values of corresponding elements Z(0, 0), Z(1, 2), Z(2, 3) and Z(3, 1) in the block matrix Z are also respectively different values of 0, 1, 3 and 2. Similarly, the four elements of a same value in the block matrix BM also correspond to four elements of different values in the dot matrix DM. For example, four diagonal elements Y(0, 0), Y(1, 1), Y(2, 2) and Y(3, 3) are all 1; conversely, four diagonal elements in the dot matrices A, B, C and D are different values from 0 to 3.

When providing the switched dot matrices DMa/DMb/DMc and the switched block matrices BMa/BMb/BMc by performing switching on the dot matrix DM and the block matrix BM, the switched dot matrices DMa/DMb/DMc have same characteristics as those of the dot matrix DM, and the switched block matrices BMa/BMb/BMc have same characteristics as those of the block matrix BM. For example, in each column and each row of the switched dot matrices and the switched block matrices, the four elements of a same column have different values respectively being one from 0 to 3; the four elements of a same row also have different values respectively being one from 0 to 3. Similarly, the four elements with a same value in the switched dot matrix correspond to four elements with different values in the switched block matrix, just as the corresponding relationship between the dot matrix and the block matrix, so that the sixteen 4-bit elements in the dither matrices DTM2/DTM3/DTM4 cover all values from 0 to 15.

In continuation of the embodiments shown in FIGS. 4 and 5, FIGS. 6 and 7 illustrate the dither matrix/dither pattern being updated along with switching of frames by taking the dither matrix DTM1 as an example. For example, in FIG. 6, DTM1@F(k) represents the dither matrix DTM1 of the frame F(k); in FIG. 7, DTM1@F(k+8) represents the dither matrix DTM1 of the frame F(k+8).

In the dot matrix/switched dot matrices and block matrix/switched dot matrices, since elements of a same value do not exist in a same row or a same column, n sub-pixels displaying the color level L1 are evenly distributed among the columns and rows when simulating the color level (L0+n*(L1−L0)/16) by displaying one of the color levels L0 and L1 with the 4*4 corresponding sub-pixels in the dither matrices. That is, supposing n=(4*n1+n0) (where n0 is greater than 0 and smaller than 4, and n1 is greater than or equal to 0 and smaller than 4), in four columns corresponding to a same dither matrix, the color level L1 is displayed by (n1+1) sub-pixels in the n0 column and is respectively displayed by n1 sub-pixels in other columns. Similarly, in four rows corresponding to a same dither matrix, the color level L1 is displayed by (n1+1) sub-pixels in the n0 row and is respectively displayed by n1 sub-pixels in the other rows. With the arrangement above, a maximum difference between the numbers of sub-pixels in respective columns/rows for displaying the color level L1 does not exceed one such that the sub-pixels for displaying the color level L1 are not concentrated at a same column/row. For example, when n=9, the color level L1 are displayed by three sub-pixels in a predetermined column/row and is displayed by two sub-pixels in the other three columns/rows.

Taking a dither pattern DTM1@F(k+2) corresponding to the frame F(k+2) in FIG. 6 as an example, when n=9, the sub-pixels for displaying the color level L1 correspond to elements DTM1(0, 2), DTM1(1, 2), DTM1(0, 0), DTM1(2, 3), DTM1(3, 1), DTM1(0, 3), DTM1(1, 1), DTM1(3, 2) and DTM1(2, 0), (respectively with values from 7 to 15). Out of the four rows, row 0 corresponds to three sub-pixels of the color level L1, and rows 1 to 3 correspond to two sub-pixels of the color level L1. Similarly, out of the four columns, column 0 corresponds to three sub-pixels of the color level L1, and columns 1 to 3 correspond to two sub-pixels of the color level L1.

It is observed from FIG. 4 that, in temporal dithering, in the sixteen neighboring frames F(k) to F(k+15) within four periods T0(1) to T0(4) each comprising four frames, the dot matrices are respectively A, B, C, D, A, B, C, D, A, B, C, D, A, B, C and D, and the block matrices are respectively W, X, Y, Z, X, Y, Z, W, Y, Z, W, X, Z, W, X and Y. In the 16-frame period T1, each dot matrix appears a plurality of times in a plurality of frames, and corresponds to a different block matrix in each appearance. For example, the dot matrix A is selected in the frames F(k), F(k+4), F(k+8) and F(k+12). In these frames, the corresponding block matrices are the four different block matrices W, X, Y and Z. With the sequence above, each element in the dither matrix is respectively set to one from 0 to 15 in the sixteen frames within the frame period T1 to perform temporal dithering.

For example, it is observed from FIGS. 6 and 7 that, within the 16-frame period from the frames F(k) to F(k+15), the element DTM1(0, 0) in the dither matrix DTM1 is sequentially set to 7, 14, 9, 0, 6, 13, 8, 3, 5, 12, 11, 2, 4, 15, 10 and 1, which cover all integrals between 0 to 15. Similarly, the value of the element DTM1(1, 2) is sequentially set to 6, 15, 8, 1, 7, 12, 9, 2, 4, 13, 10, 3, 5, 14, 11 and 0.

To switch a predetermined sub-pixel among sixteen frames to display the neighboring color levels L0 and L1 in order to simulate the color level (L0+n*(L1−L0)/16), since the dot matrix/switched dot matrices control the two most significant bits of the elements in the dither matrices, n frames for displaying the color level L1 are evenly distributed to four 4-frame periods T0(1) to T0(4). That is, when n=(4*n1+n0) (where n0 is greater than 0 and smaller than 4, and n1 is greater than or equal to 0 and smaller than 4), the color level L1 is to be displayed (n1+1) times within n0 4-frame periods, and to be displayed n1 times in the other 4-frame periods. In each 4-frame period, the number of times (frames) for displaying the color level L1 varies by once the maximum, and is not excessively concentrated in a same 4-frame period. For example, when n=9, a predetermined sub-pixel respectively displays the color level L1 three times in three frames of one 4-frame period, and respectively displays the color level L1 twice in the other three 4-frame periods. Taking the sub-pixel corresponding to the element DTM1(0, 0) for example, in its corresponding frames F(k), F(k+1), F(k+2), F(k+5), F(k+6), F(k+9), F(k+10), F(k+13) and F(k+14) for displaying the color level L1, the color level L1 is to be displayed three times in the 4-frame period T0(1) and twice in the other periods T0(2) to T0(4).

In contribution to the sub-pixels processed by the dither pattern/dither matrices of the present invention instead of pixels, undesired patterns resulting from dithering are improved. Taking temporal dithering for example, supposing the R sub-pixel in the dither matrix element DTM1(0, 0) is to alternate in a 16-frame period to simulate a color level (R0+(R1−R0)/16) with neighboring color levels R0 and R1, a color level (G0+(G1−G0)/16) is simulated by a G sub-pixel corresponding to the element DTM1(0, 1) with color levels G0 and G1 in the same period, and a color level (B0+(B1−B0)/16) is to be simulated by a B sub-pixel corresponding to the element DTM1(0, 2) with color levels B0 and B1 in the same period. With reference to FIGS. 6 and 7, the R sub-pixel corresponding to the element DTM1(0, 0) displays the color level R1 in the frame F(k+13) and the color level R0 in the other 15 frames; the G sub-pixel corresponding to the element DTM1(0, 1) displays the color level G1 in the frame F(k+12), and the B sub-pixel corresponding to the element DTM1(0, 2) displays the color level B1 in the frame F(k+15). It is concluded from the above discussion that, the three R, G and B sub-pixels do not gather in a same frame to simultaneously display the color level (R1, G1, B1) when implementing the dithering technique of the present invention.

Figure 9:
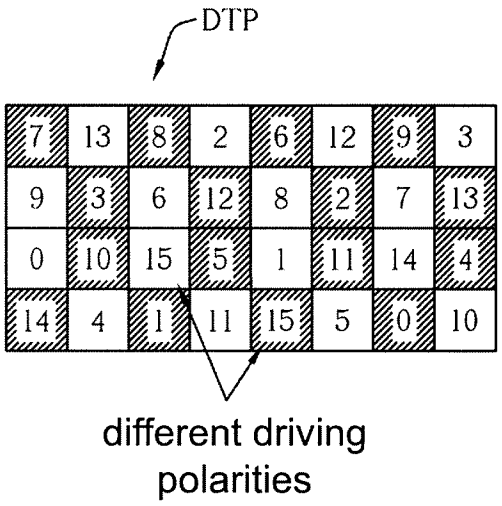
FIGS. 8 to 10 are dither patterns according to an embodiment of the present invention.
Figure 8:
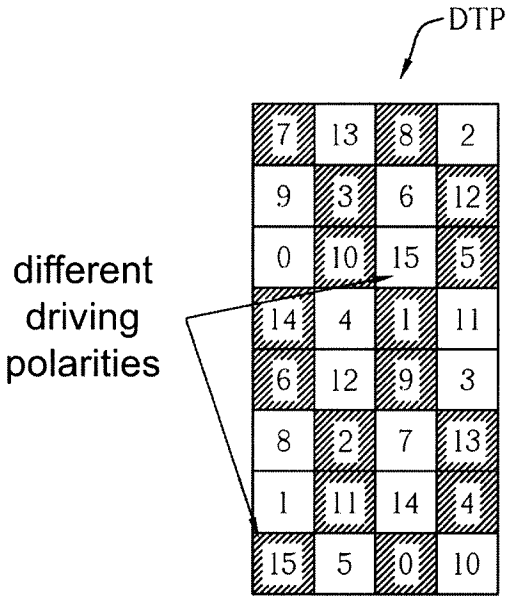
Figure 10:
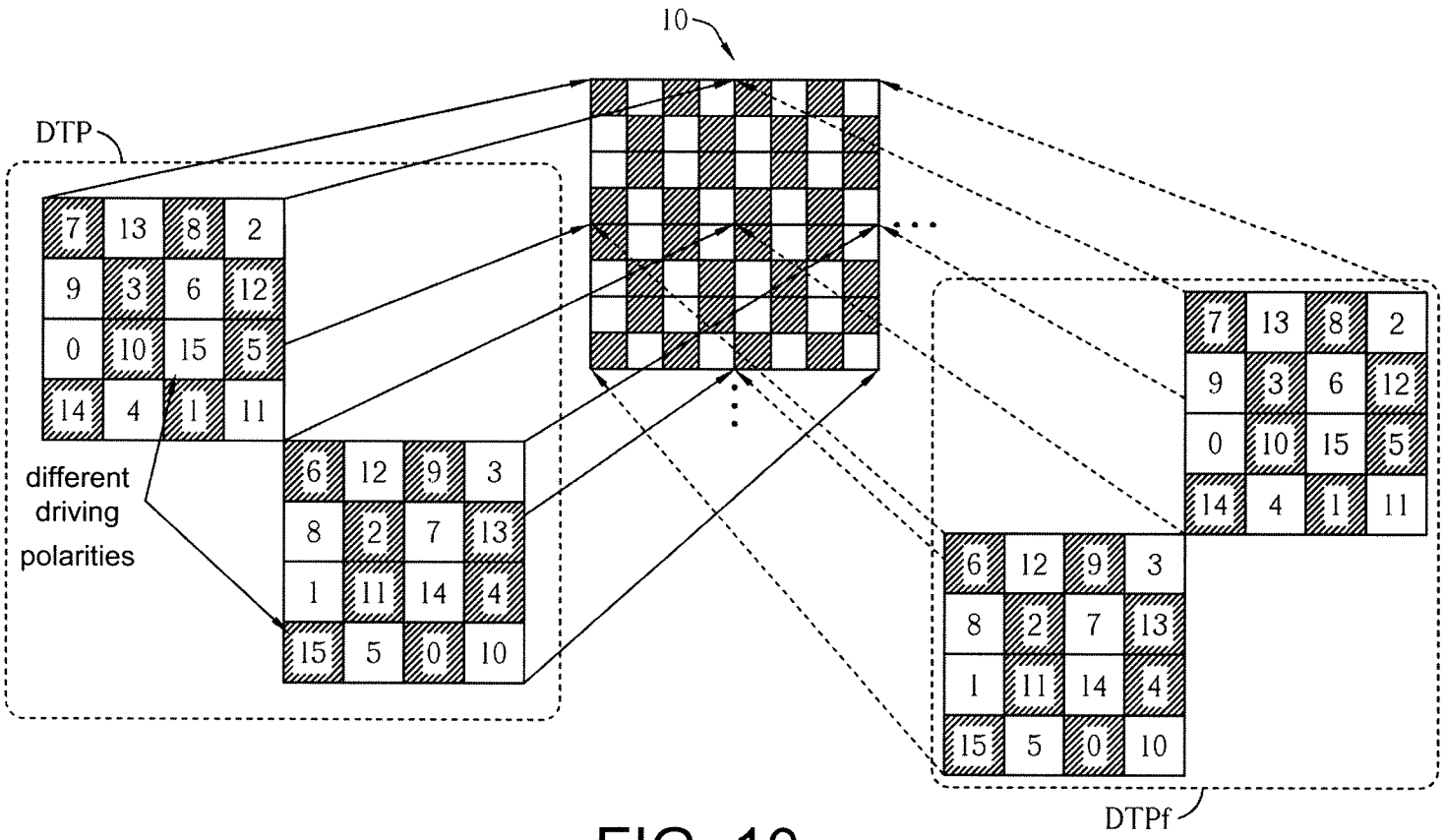

FIGS. 8 to 10 illustrate dither patterns according to different embodiments of the present invention. In FIG. 8, the dither pattern DTP is an 8*4 matrix. In FIG. 9, the dither pattern DTP is a 4*8 matrix. In FIG. 10, the dither pattern DTP is formed by two 4*4 diagonally arranged matrices, and cooperates with a horizontally flipped dither pattern DTPf to correspond to the sub-pixels of the display panel 10. In the dither patterns DTP of FIGS. 8 to 10, the quantity of same-valued elements is 2 to respectively correspond to different driving polarities to balance differences between the different driving polarities.

In FIG. 1, suppose a driving polarity mode is that the middle two scan lines (e.g., scan lines where the sub-pixels S(1, 0) and S(2, 0) are situated) of every four scan lines are of a same polarity when the display panel 10 is driven. Other driving polarity modes may include: first two scan lines of every four scan lines correspond to a same polarity while the last two correspond to the other polarity; alternatively, the first and third scan lines of every four scan lines correspond to a same polarity while the second and fourth scan lines correspond to the other polarity. The dithering technique of the present invention may be further applied to all kinds of driving polarity modes. Preferably, when implementing the dithering technique of the present invention, the dither pattern is provided with an even number of same-valued elements, with half of which corresponding to one polarity while the other half corresponding to the other driving polarity, so as to reduce flickering.

In various driving polarity modes, a half of every 4*4 neighboring sub-pixels corresponds to one polarity while the other half corresponds to the other driving polarity. However, when simulating the color level (L0+n(L1−L0)/16) with 4*4 sub-pixels, n sub-pixels that need to display the color level L1 cannot numerically maintain a balance between driving polarities when n is an odd number. For example, when n=9, out of nine sub-pixels for displaying the color level L1, an optimal situation is that four sub-pixels correspond to one polarity while the other five sub-pixels correspond to the other polarity, leaving one of the polarity prevailing over the other. Preferably, the dither pattern is arranged by an even number of (paired) 4*4 matrices to simulate the color level (L0+n*(L1−L0)/16) by sub-pixels corresponding to the paired 4*4 matrices, so that the sub-pixels are capable of numerically maintaining the balance between different polarities. Again taking n=9 as an example, in every two paired 4*4 matrices, four and five sub-pixels respectively correspond to a same polarity while five and four sub-pixels correspond to the other polarity. Thus, the numbers of sub-pixels of different polarities are balanced to optimize the counteraction against flickering.

Figure 11:
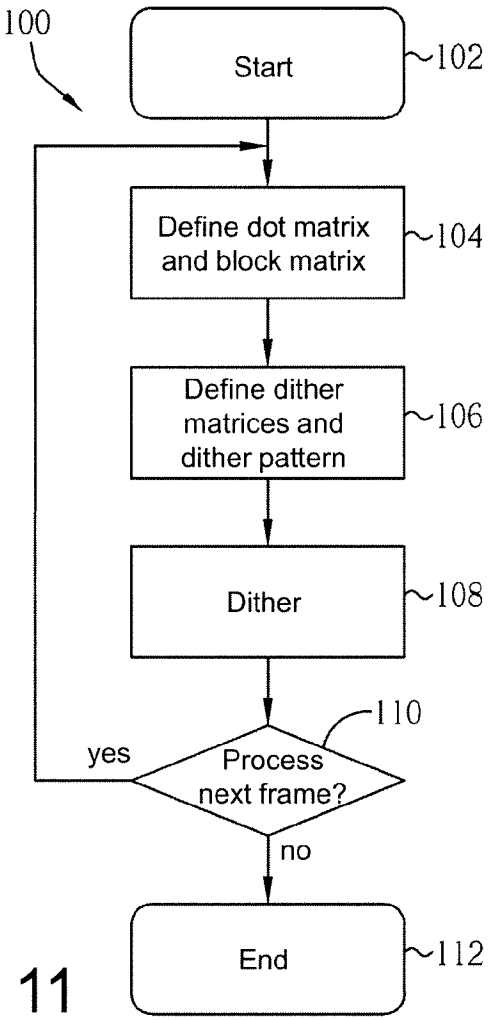
FIG. 11 shows a flowchart of a dithering process according to an embodiment of the present invention.

FIG. 11 shows a flowchart 100 of a dithering method according an embodiment of the present invention. In Step 102, the method begins to start the dithering process.

In Step S104, for a predetermined frame of image data, a dot matrix and a block matrix are defined, and row-switching/column-switching is performed on the dot matrix and block matrix to respectively provide switch dot matrices and switched block matrices. The dot matrix/switched dot matrices and the block matrix/switched block matrices are provided as described in the foregoing description.

In Step 106, the dither matrices are formed by the dot matrix/switching dot matrices and the block matrix/switching block matrices, and the dither pattern DTP is formed by the dither matrices, in a way that the dither pattern DTP possesses characteristics in the foregoing description. For example, in the dither pattern DTP, same-valued elements correspond to different polarities to reduce/counteract flickering.

In Step 108, dithering is performed according to the elements of the dither pattern and sub-pixel data of the sub-pixels to obtain color levels to be displayed by the sub-pixels. Principles of the dithering process are as previous described with reference to FIG. 3.

In Step 110, it is determined whether a next frame is to be processed. The method iterates Step 104 when a result is affirmative to redefine the dot matrix/switched dot matrices and the block matrix/switched block matrices according to a dot matrix sequence and a block matrix sequence; or the method proceeds to Step 112 when the result is negative to end the flow 100.

Figure 12:
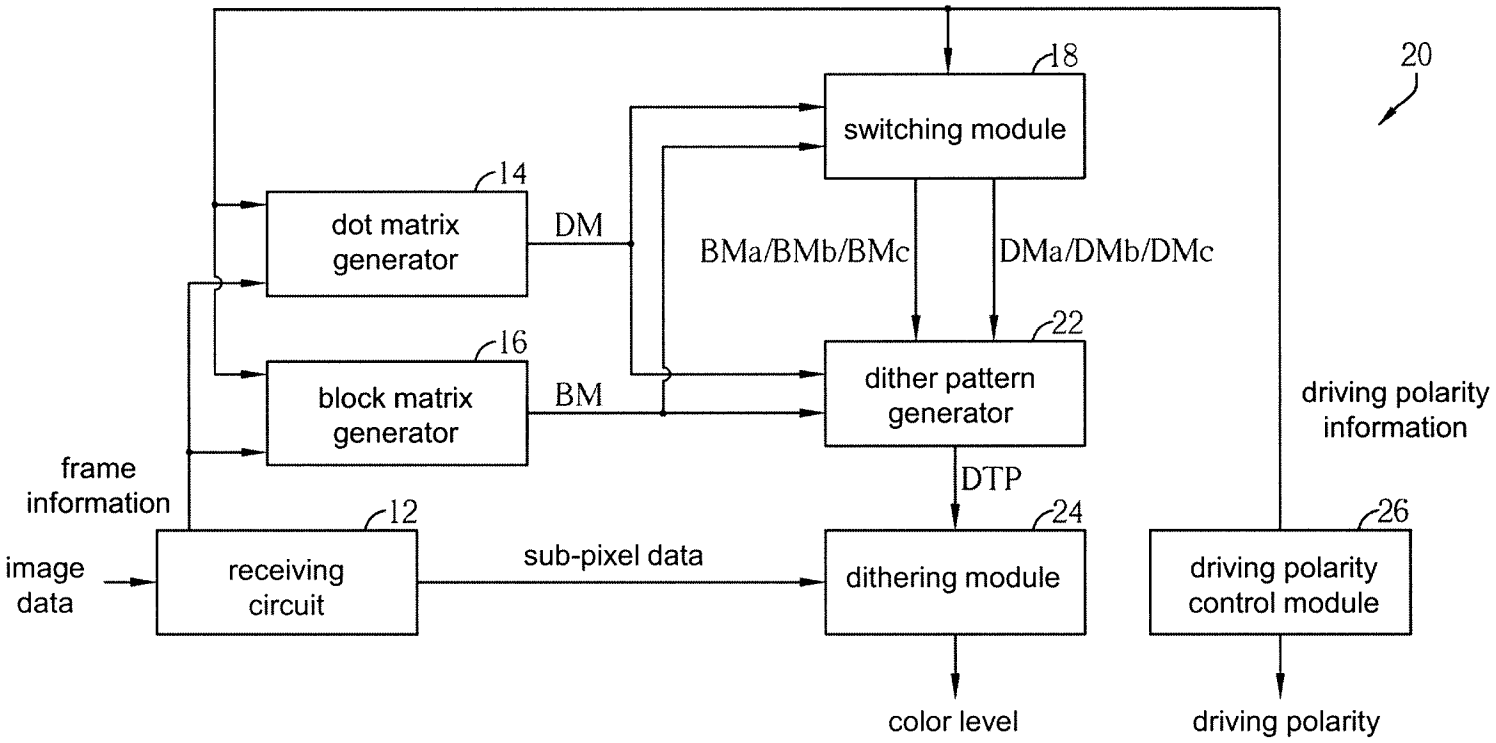
FIG. 12 shows a block diagram of a dither control circuit according to an embodiment of the present invention.

FIG. 12 shows a block diagram of a dither control circuit 20 for realizing the dithering technique according to one embodiment of the present invention. For example, the dither control circuit 20 is implemented to a timing controller of a display panel. In this embodiment, the dither control circuit 20 comprises a receiving circuit 12, a dot matrix generator 14, a block matrix generator 16, a switching module 18, a dither pattern generator 22, a dithering module 24, and a driving polarity control module 26. The receiving circuit 12 receives image data, obtains sub-pixel data (e.g., 10-bit sub-pixel data) in the frames, and provides associated frame information (e.g., a time point for switching to a next frame). The driving polarity control module 26 controls the polarity to which the sub-pixels correspond according to a predetermined driving polarity mode. For example, the driving polarity control module 26 supports multiple driving polarity modes, and provides corresponding driving polarity mode information according to a currently adopted driving polarity mode.

According to the driving polarity mode and frame information, the dot matrix generator 14 and the block matrix generator 16 correspondingly provides the dot matrix DM and block matrix BM as the frames are updated. The switching module 18 provides the corresponding switching dot matrices DMa to DMc and the switching block matrices BMa to BMc. According to the dot matrix/switching dot matrices and the block matrix/switching block matrices, the dither pattern generator 22 forms the dither matrices and the dither pattern DTP. The dithering module 24 outputs the color levels, e.g., 6-bit color levels, to be displayed by the sub-pixels according to the dither pattern DTP and the sub-pixel data corresponding to the sub-pixels in the frames.

In the dither control circuit 20, the dot matrix generator 14, the block matrix generator 16, the switching module 18, the dithering generator 22 and the dithering module 24 may be realized by hardware, software or firmware.

In conclusion, compared to the conventional dithering technique, the dithering technique of the present invention takes polarities of sub-pixels into consideration to provide a dither pattern with spatial and temporal balance in view of sub-pixels, so that patterns that undesirable affect visual effects are prevented to improve flickering.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dithering method, applied in a display panel to display image data comprising a plurality of frames each comprising a plurality of sub-pixel data, the display panel comprising a plurality of pixels each comprising a plurality of sub-pixels, each sub-pixel for displaying a plurality of color levels and each sub-pixel corresponding to one of a plurality of driving polarities, the method comprising:

defining a dither pattern comprising a plurality of elements each associated with a sub-pixel, wherein each element has a numerical value;

pairing same-valued elements among the elements, and respectively corresponding the paired same-valued elements to two sub-pixels with different polarities in the sub-pixels; and determining a color level to be displayed by each sub-pixel from two predetermined color levels of the color levels according to the elements in the dither pattern corresponding to the sub-pixels.

2. The method according to claim 1, wherein the defining step further comprises:

arranging a dot matrix and a block matrix, the dot matrix comprising a plurality of elements arranged in a plurality of columns and a plurality of rows, and the block matrix comprising a plurality of elements arranged in a plurality of columns and a plurality of rows; and synthesizing a plurality of dither matrices in the dither pattern according to the dot matrix and the block matrix, each dither matrix comprising a plurality of elements arranged in a plurality of columns and a plurality of rows.

3. The method according to claim 2, wherein the synthesizing step comprises:

performing row-switching and column-switching on the dot matrix and the block matrix to provide a switched dot matrix and a switched block matrix; and defining at least one of the dither matrices according to the switched dot matrix and the switched block matrix.

4. The method according to claim 2, further comprising:

defining at least one of the dither matrices according to a sum of a product of multiplying the dot matrix with a predetermined value and the block matrix.

5. The method according to claim 2, further comprising:

providing the elements in the columns in the dot matrix as different values, respectively, and providing the elements in the rows in the dot matrix as different values, respectively;

providing the elements in the columns in the block matrix as different values, respectively, and providing the elements in the rows in the block matrix as different values, respectively;

corresponding each element in the block matrix to one of the elements in the dot matrix; and corresponding the elements of a same value in the dot matrix to the elements of different values in the block matrix.

6. The method according to claim 2, further comprising:

providing the elements in the dither matrix as different numbers.

7. The method according to claim 2, further comprising:

rearranging the dot matrix and the block matrix when displaying different frames of the frames, and resynthesizing the dither matrices according to the redefined dot matrix and block matrix.

8. The method according to claim 7, further comprising:

setting a dot matrix sequence associated with a first number of dot matrices;

determining a block matrix sequence associated with a second number of block matrices;

periodically selecting one of the dot matrices corresponding to the dot matrix sequence when rearranging the dot matrix; and periodically selecting one of the block matrices corresponding to the block matrix sequence when rearranging g the block matrix;

wherein, the first number differs from the second number.

9. The method according to claim 1, further comprising:

resynthesizing the dither pattern when displaying different frames among the frames.

10. The method according to claim 9, further comprising:

periodically resetting an element corresponding to a same position to different values in every predetermined number of frames.

11. A dither control circuit, applied in a display panel to display image data comprising a plurality of frames each comprising a plurality of sub-pixel data, the display panel comprising a plurality of pixels each comprising a plurality of sub-pixels for displaying a plurality of color levels according to a plurality of driving polarities, the apparatus comprising:

a dot matrix generator, for receiving a driving polarity mode to generate a dot matrix, wherein the dot matrix comprises a plurality of elements and each element has a numerical value;

a block matrix generator, for receiving the driving polarity mode to generate a block matrix;

a dither pattern generator, coupled to the dot matrix generator and the block matrix generator, for synthesizing a dither pattern according to the dot matrix and the block matrix; and a dithering module, coupled to the dither pattern generator, for dithering the sub-pixel data according to the dither pattern.

12. The dither control circuit according to claim 11, further comprising:

a switching module, for performing column-switching and row-switching on the dot matrix and the block matrix to provide a switched dot matrix and a switched block matrix;

wherein, the dither pattern generator synthesizes the dither matrices according to the switched dot matrix and the switched block matrix.

13. The dither control circuit according to claim 11, wherein the dither pattern generator generates the dither matrices according to a sum of a product of multiplying the dot matrix with a predetermined value and the block matrix.

14. The dither control circuit according to claim 11, wherein the dot matrix comprises a plurality of columns and a plurality of rows, the elements in the rows of the dot matrix are of different values, and the elements in the rows of the dot matrix are of different values; the block matrix comprises a plurality of columns and a plurality of rows, the elements in the rows of the block matrix are of different values, and the elements in the rows of the block matrix are of different values; each element of the block matrix corresponds to one of the elements of the dot matrix; and the elements of a same value in the dot matrix correspond to the elements of different values in the block matrix.

15. The dither control circuit according to claim 11, wherein the elements of the dither matrix are of different values.

16. The dither control circuit according to claim 11, wherein the dot matrix generator redefines the dot matrix and the block matrix generator redefines the block matrix when displaying different frames of the frames, and the dither pattern generator resynthesizes the dither matrices according to the redefined dot matrix and the redefined block matrix.

17. The dither control circuit according to claim 16, wherein the dot matrix generator defines a dot matrix sequence, which corresponds to a first number of dot matrices; the block matrix generator defines a block matrix sequence, which corresponds to a second number of block matrices; the dot matrix generator periodically selects one of the dot matrices corresponding to the dot matrix sequence when redefining the dot matrix; the block matrix generator periodically selects one of the block matrices corresponding to the block matrix sequence when redefining the block matrix; and the first number differs from the second number.

18. The dither control circuit according to claim 11, wherein the dot matrix generator generates the dot matrix according to the driving polarity mode and frame information, and the block matrix generator generates the block matrix according to the driving polarity mode and the frame information.

19. The dither control circuit according to claim 11, wherein the element corresponding to a same sub-pixel is periodically corresponded to a different number in every predetermined number of frames when the dither pattern generator resynthesizes the dither pattern.

* * * * *